US005489737A

United States Patent [19]

Baba et al.

[11] Patent Number: 5,489,737

[45] Date of Patent: Feb. 6, 1996

[54] RADIOACTIVE WASTE PROCESSING SYSTEM

[75] Inventors: Tsutomu Baba; Masami Matsuda; Takashi Nishi; Koichi Chino; Makoto Kikuchi, all of Hitachi; Shin Tamata, Higashi-Ibaraki, all of Japan

[73] Assignee: Hitachi, Ltd., Tokyo, Japan

[21] Appl. No.: 924,482

[22] Filed: Aug. 4, 1992

[30] Foreign Application Priority Data

Aug. 8, 1991 [JP] Japan ..... 3-199622

[51] Int. Cl.[6] ..... G21F 9/00

[52] U.S. Cl. ..... 588/2; 588/20; 588/19; 976/DIG. 384; 976/DIG. 385

[58] Field of Search ..... 252/626, 628, 252/633; 588/2, 19, 20; 976/DIG. 384, DIG. 385

[56] References Cited

U.S. PATENT DOCUMENTS

| | | | |
|---|---|---|---|
| 3,922,974 | 12/1975 | Hempelmann | 110/8 R |
| 4,559,170 | 12/1985 | Gay et al. | 252/628 |
| 4,636,336 | 1/1987 | Gay et al. | 252/632 |
| 4,654,172 | 3/1987 | Matsuda et al. | 252/629 |
| 4,793,947 | 12/1988 | Izumida et al. | 252/628 |
| 4,834,914 | 5/1989 | Jackson | 252/633 |
| 4,980,090 | 12/1990 | Manchak, Jr. | 252/628 |
| 5,122,268 | 6/1992 | Burack et al. | 210/202 |
| 5,133,901 | 7/1992 | Peterson et al. | 252/626 |
| 5,143,654 | 9/1992 | Kikuchi et al. | 252/629 |
| 5,257,297 | 10/1993 | Keda et al. | 376/310 |

*Primary Examiner*—Ngoclan Mai

*Attorney, Agent, or Firm*—Antonelli, Terry, Stout & Kraus

[57] ABSTRACT

A processing system for radioactive waste is composed of an adjusting tank having a sampling port, a solidification processing system, and a package inspection apparatus, and a package, of which inventory per a package has been exactly grasped, is prepared by solidification of the waste with the processing system after determining radioactivity of the waste by measurement before the solidifying process.

In accordance with the present invention, data on radioactivity before and after preparation of package of waste become clear, and management of each package at transportation and intermediate storage of the packages is facilitated.

11 Claims, 9 Drawing Sheets

RADIOACTIVE WASTE PROCESSING SYSTEM

BACKGROUND OF THE INVENTION

The present invention relates to a radioactive waste processing method, especially to a processing system for radioactive waste resin, condensed waste liquid, incinerated ashes, and non-burnable miscellaneous solid bodies etc.

Hitherto, as for solidification technique, cement solidification (JP Appl. No. 62-124872 (1987)) and plastic solidification (JP Appl. No. 62-268055 (1987)) have been used. As for methods for solidification process, JP Appl. No. 63-33541 (1988), JP Appl. No. 63-11687 (1988) were disclosed. The above described methods for solidification have been established, and packages having superior integrity can be, actually have been, prepared by the above described methods,. As storage in land becoming concrete, measurement of exact inventory of radioactivity per a package has become a problem. Accordingly, research on transportation managing system has progressed in order to measure radioactivity per a package which is processed by the solidification process, and measuring methods have been disclosed in JP Appl. No. 61-26345 (1986) and JP Appl. No. 2-157340 (1990). Farther, a method wherein radioactivity of nuclides other than Co-60 and Cs-137 are estimated by evaluating safety factor higher than radioactivity of Co-60 and Cs-137 (scaling factor method) is going to be applied to transportation management. However, reproducibility of correlation between Co-60, Cs-137, and other nuclides, which is one of fundamentals of the scaling factor, is not so well established, and accordingly, the correlation obtained by experiments or actual measurement is multiplied by 10–100 as a safety factor in actual use. That means, the above described method evaluates the correlation in safety side as much, but there is a possibility to overestimate the radioactivity of a package.

By the above described conventional technique, it was difficult to grasp exactly sort and quantity of nuclides in a package even though total approximate inventory of the radioactivity per a package could be grasped. And, by the scaling factor method, radioactivity was evaluated in safety side more than necessity, and there was such a problem that actually transportable package was reprocessed or kept in storing at the site. All the above mentioned problems are caused by a fact that exact grasp of radioactivity and sort of contained nuclides per a package was impossible.

SUMMARY OF THE INVENTION

The object of the present invention is to solve the above described problems.

In order to solve the above described problems, a part or all of radioactive waste in a storage tank is transferred to an adjusting tank, and after measurement of radioactive concentration of each nuclide in the waste, the waste is processed by one of processing methods in one or a plurality of choices which contain at least one of the processing methods described hereinafter.

(1) Returning to the storage tank without introducing to a solidifying processing system.
(2) Processing residue for solidification after incinerating process.
(3) Processing the residue for solidification after removal of functional groups and radioactive nuclides by thermal decomposition.
(4) Processing the residue after separation and removal of radioactive nuclides by dissolution process.

(5) Introducing directly to a solidifying processing system and solidifies with inorganic solidifying agents or organic solidifying agents.
(6) Introducing gaseous waste generated at intermediate processes to an exhausted gas processing system.
(7) Mixing with other waste so as to adjust radioactivity per a package to a predetermined value in order to facilitate handling.

That means, a process for exact grasp of contained radioactive nuclides and radioactive concentration in waste is introduced into a waste processing system at prior step to the solidifying process. Besides, in order to grasp inventory per a package more precisely, weight and surface dose of the package after the solidifying process is measured, and the obtained data are combined with the data obtained before the solidifying process. At least one of the above described two processes is introduced into the radioactive waste processing system.

By introducing the process for exact grasp of contained radioactive nuclides and radioactive concentration in waste at prior step to the solidifying process, waste management after preparation of the package is facilitated and can be performed correctly. That means, as the inventory of radioactivity in the waste is previously grasped exactly, handling of the waste at transportation can be performed by only a sampling inspection. Farther, by measuring weight and surface dose of the package after the solidifying process and combining the obtained data with the data before the solidification process, exact labelling for each package becomes possible.

DETAILED DESCRIPTION OF THE EMBODIMENTS

Embodiment 1

Figure 1:
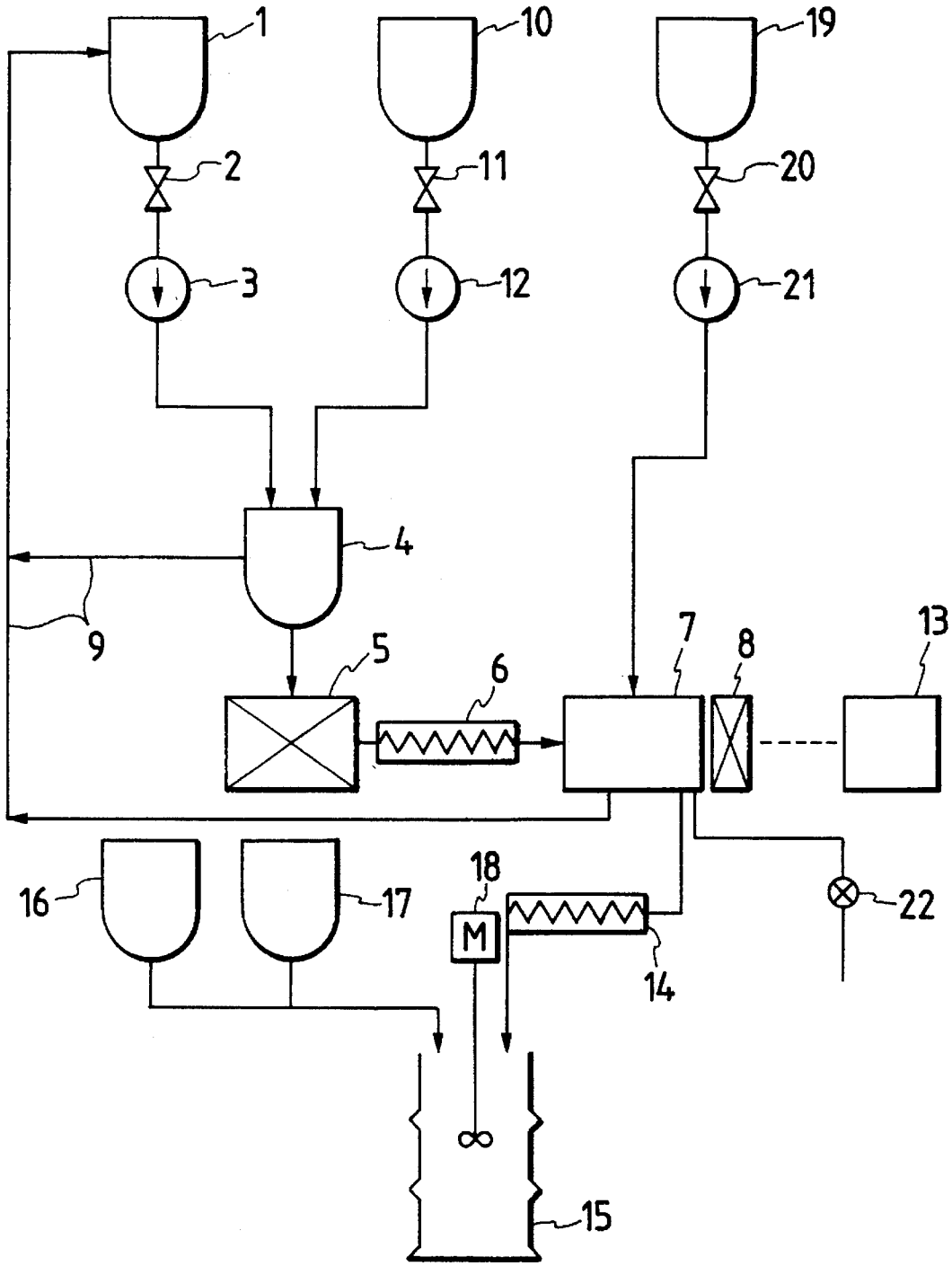
FIG. 1 is a waste processing flow diagram for explanation of an embodiment of the present invention.
Figure 2:
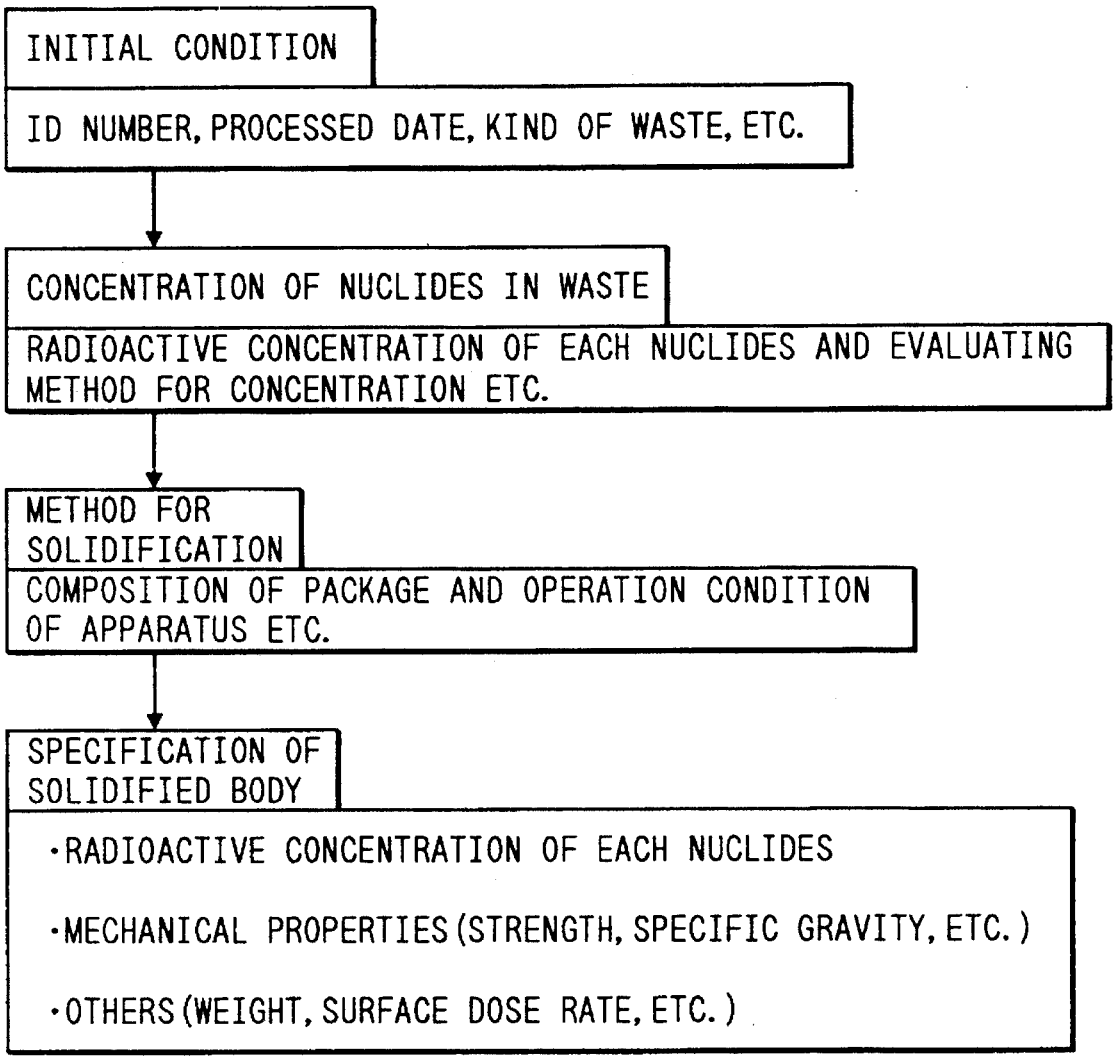
FIG. 2 is a flow diagram indicating the data processing method for the computer used in a embodiment of the present invention.

One of the embodiments of the present invention is explained referring to FIGS. 1 and 2.

The present embodiment is a process for solidifying three kinds of waste such as used ion exchange resin (waste resin), incinerated ashes, and concentrated waste liquid, all of which are generated from a boiling water reactor nuclear power plant, with cement, and radioactivity of the obtained package is controlled so as not to exceed a statutory determined upper limit. The statutory determined upper limit of radioactive concentration used in the present embodiment is as follows;

TABLE 1

| Nuclides | Upper limit concentration |
|---|---|
| H-3 | $3.1 \times 10^{11}$ (Bq/t) |
| C-14 | $8.5 \times 10^{9}$ (Bq/t) |
| Co-60 | $2.8 \times 10^{12}$ (Bq/t) |
| Ni-59 | $8{,}9 \times 10^{9}$ (Bq/t) |
| Ni-63 | $1.1 \times 10^{12}$ (Bq/t) |
| Sr-90 | $1.7 \times 10^{10}$ (Bq/t) |
| Nb-94 | $8.5 \times 10^{7}$ (Bq/t) |
| Tc-99 | $1.9 \times 10^{7}$ (Bq/t) |
| I-129 | $2.8 \times 10^{5}$ (Bq/t) |
| Cs-137 | $1.0 \times 10^{11}$ (Bq/t) |
| α nuclide | $5.6 \times 10^{8}$ (Bq/t) |

Waste resin powder, which was generated mainly from clean up systems of nuclear reactors and stored in the sludge tank 1 having storing capacity of 100 $m^3$, was transported to the adjusting tank 4 of capacity 5 $m^3$ by the suction pump 3 through the valve 2 in a condition of 5% slurry. Subsequently, a part of the waste resin (concentration is 5%), about 600 kg, in the adjusting tank 4 was transported to the dehydrater 5, water content was decreased to 70% by centrifugal dehydration, and the waste resin in a cake-like condition was sent to the radioactivity measuring barrel 7 by the screw feeder 6. Semiconductor detectors 8 were so installed in the radioactivity measuring barrel 7 as to measure concentration of Co-60 and Cs-137 in the waste resin. Result of the measurement revealed that concentration of respective Co-60 and Cs-137 was $1\times10^{15}$ Bq/t and $2\times10^{9}$ Bq/t, and concentration of the Co-60 was higher by three orders than the statutory upper limit concentration shown in Table 1.

If the waste resin was solidified without any further treatment, the obtained package could not be disposed in a land disposal. Accordingly, solidifying processing was discontinued, and the waste resin in the adjusting tank 4 and the radioactivity measuring barrel 7 was returned to the sludge tank 1 through the by-path line 9.

Next, processing of waste resin stored in another tank was intended. Waste resin particles, which were mainly generated from condensate clean up systems and stored in the resin tank 10 having storing capacity of 50 $m^3$, were transferred to the adjusting tank 4 by the suction pump 12 through the valve 11 in a condition of 20% slurry. Subsequently, a part of the waste resin (concentration is 20%), about 250 kg, in the adjusting tank 4 was transferred to the dehydrater 5, water content was decreased to 50% by centrifugal dehydration, and the waste resin was introduced to the radioactivity measuring barrel 7 by the screw feeder 6. Results of the measurement on concentration of Co-60 and Cs-137 revealed that concentration of respective Co-60 and Cs-137 were $2\times10^{9}$ Bq/t and $4\times10^{6}$ Bq/t, and the concentration both of the Co-60 and Cs-137 were remarkably lower than the statutory upper limit concentration shown in Table 1. Subsequently, the maximum value of radioactivity of other nuclides was estimated by so-called scaling factor (SF) method. Concretely saying, values for Ni-59, Ni-63, and Nb-94, all of which were corrosion products, were obtained by multiplying the concentration of Co-60 with SF values, such as $1\times10^{8}$ Bq/t for Ni-59, $2\times10^{10}$ Bq/t for Ni-63, and $4\times10^{6}$ Bq/t for Nb-94 at the maximum. And, values for Sr-90, 1-129, and α nuclides, all of which were fission products, were obtained by multiplying the concentration of Cs-137 with SF values, such as $3\times10^{7}$ Bq/t for Sr-90, $3\times10^{1}$ Bq/t for 1-129, and $3\times10^{6}$ Bq/t for α nuclides at the maximum. And, as values for H-3 and C-14, respectively 1×10 Bq/t and 7×10 were known from actual data obtained by so-called mean value method. As the result of evaluation on concentration of nuclides other than Co-60 and Cs-137 based on the observed values for Co-60 and Cs-137 in the manner as above described, it was revealed that each concentration of all nuclides in the specimen was lower than the upper limit values shown in Table 1. However, in the evaluation of concentration by SF method, safety margin of 100 times was added to the observed data on SF values.

In accordance with the above described result, it was decided to supply the above described data to the computer 13 and to execute the solidifying process because it was assumed that the obtained package would be acceptable for disposal in land when the waste resin was processed for solidification.

The waste resin (weight 100 kg., moisture content 50% in the radioactivity measuring barrel 7 was transmitted to the solidifying vessel 15 by the screw feeder 14, and 120 kg. of solidifying agents (fiber reinforced cement disclosed in JP appl. No. 1-221502 (1989) was used in the present embodiment) which was mainly composed from cement and 60 kg. of kneading water including 1 kg. of water reducing agent were supplied from the cement silo 16 and the water tank 17 respectively. The solidifying vessel 15 was furnished with the agitator 18, which was used for preparation of cement paste by agitation, and the package was obtained. At that time, data on waste resin, solidifying agents, and kneading water, all of which were supplied into the solidifying vessel 15, were put in the computer 13.

The package obtained by the above described method was sufficient in mechanical properties such as strength, and had lower radioactive concentration for each nuclide than the upper limit concentration for each nuclide shown in Table 1.

Embodiment 2

Next, processing procedure on data supplied to the computer 13 is explained referring to FIG. 2.

To the computer 13, initial conditions (such as ID number, processing date, sort of objective waste for solidification, and background of generation etc.) relating to the solidifying process are previously supplied. Subsequently, radioactive concentration of each nuclide in the objective waste is recorded based on measured result at the radioactivity measuring barrel 7. At that time, data on evaluating method of the concentration are also stored. That is, data recording that Co-60 and Cs-137 are directly measured, Ni-59, Ni-63, Nb-94, Sr-90, I-129, and a nuclides are evaluated by SF method, and H-3 and C-14 are evaluated by mean value method in the present embodiment are stored. Next, data on the solidifying method of the waste are stored. That means, sort and quantity of waste solidifying agents and kneading water used in the operation, operating condition of the solidifying apparatus, and specification of the solidifying vessel used in the operation are recorded. In accordance with the above described data, physical properties of the finally obtained package can be evaluated by the following procedure.

First, radioactive concentration of each nuclide can be easily calculated from data on the concentration of the waste itself and on composition of the package (weight percentage of waste/solidifying agents/kneading water). Mechanical properties of the package (such as unconfined compression strength, specific gravity, porosity etc.) can be evaluated from the data on composition of the package and the operating condition of the solidifying apparatus, and are recorded depending on necessity. And, data on finally obtained package such as weight and surface dose are preferably recorded and stored. The above described data are arranged by a predetermined format, and the package itself is recorded and labelled with the first input ID number by stamping etc. By the above described procedure, it will become possible to grasp exact history including radioactive concentration of the package when, for example, the package will be transported for disposal in land in future.

Embodiment 3

Next, a case of processing on concentrated waste liquid (CWL), of which main composition is $Na_2SO_4$, is explained referring to FIG. 1.

About 100 kg of CWL, of which concentration is about 25%, stored in the CWL tank 19 having storing capacity of 150 $m^3$ was transmitted to the radioactivity measuring barrel 7 by the pump 21 through the valve 20. At the radioactivity measuring barrel 7, concentration of Co-60 and Cs-137, both of which are gamma nuclides and concentration is easily determined by non contact measurement, were measured by the semiconductor detector 8. The result were $1\times10^{11}$ Bq/t for Co-60 and $4\times10^{5}$ Bq/t for Cs-137, and it was revealed that both of the above described concentration were less than the upper limit shown in Table 1. Subsequently, concentration of nuclides other than Co-60 and Cs-137 were evaluated by SF method. Concentration of Ni-59, Ni-63, and Nb-94 were obtained by multiplying SF values to the concentration of Co-60 as $5\times10^{9}$ Bq/t for Ni-59, $1\times10^{12}$ Bq/t for Ni-63, and $2\times10^{8}$ Bq/t for Nb-94 at the maximum, and it was revealed that concentration of Ni-59 and Ni-63 had a possibility to exceed the upper limit shown in Table 1. (Respective concentration of Sr-90, 1-129, and α nuclides was evaluated by SF method based on the concentration of Cs-137, and respective concentration of H-3 and C-14 was evaluated by mean value method, but all of the above described concentration were far lower than the upper limit shown in Table 1). Subsequently, 100 ml of CWL was taken as a sample through the sampling port furnished to the radioactivity measuring barrel 7, and concentration of Ni-59 and Ni-63, both of which are β nuclides, were measured by a liquid scintillator. As a result, it was revealed that concentration of Ni-59 was $7\times10^{7}$ Bq/t and of Ni-63 was $3\times10^{10}$ Bq/t, both of which were lower than the upper limit shown in Table 1 by two orders. The reason that the observed value becomes smaller than the value estimated by SF method is based on safety margin of about 100 times in the value estimated by SF method.

As radioactive concentration of the CWL was confirmed to be less than the upper limit shown in Table 1 as above described manner, the CWL (concentration 25%, 100 kg) was transmitted to the solidifying vessel 15 and was solidified by supplying 300 kg of solidifying agents from the cement silo 16 and kneading by the agitator 18. The obtained package was confirmed to be disposable in land, for example, in both aspects of radioactive concentration and mechanical properties. Subsequently, as same as the previously described package of waste resin, various data on the package was recorded and filed to the computer 13, and the package was so labelled with the ID number as to correspond to the record and stored in a waste storage facility.

Embodiment 4

Next, a case of processing for incinerated ashes obtained by incineration of burnable miscellaneous solid bodies is explained referring to FIG. 1 again.

About 100 kg of incinerated ashes stored in a drum was transferred to the radioactivity measuring barrel 7. As radioactive concentration of the incinerated ashes was previously estimated to be relatively high, small amount of specimen was taken as a measuring sample from the sampling port 22 furnished to the radioactivity measuring barrel 7 and measured concentration of 11 nuclides shown in Table 1 respectively. As a result, concentration of three nuclides, Ni-59, Sr-90, and α nuclides were found to exceed the upper limit shown in Table 1. Concretely saying, their concentration were $5\times10^{10}$ Bq/t for Ni-59, $2\times10^{11}$ Bq/t for Sr-90, and $6\times10^{8}$ bq/t for a nuclides. On the other hand, calculation on solidification with cement revealed that final radioactive concentration would exceed the upper limit shown in Table 1 if 100 kg of the incinerated ashes at maximum per a 200 liters drum is solidified. In the present embodiment, the above calculation was performed by the computer 13 based on the above described result of measurement on radioactive concentration. Concurrently, calculation by the computer 13 revealed that final radioactive concentration of the package would be lower than the upper limit shown in Table 1 if filling amount of the incinerated ashes per a 200 liters drum was reduced to 20 kg. Consequently, it was decided that 100 kg of the incinerated ashes in the radioactivity measuring barrel 7 would be divided into five portions, 20 kg per a portion, and five packages would be prepared (although 100 kg of the incinerated ashes could be solidified physically in a body, concentration of the radioactivity would exceed the upper limit shown in Table 1 as previously described). After 20 kg of the incinerated ashes in the radioactivity measuring barrel 7 was transferred to the solidifying vessel 15 by the screw feeder 14, 250 kg of solidifying agents from the cement silo 16 and 130 kg of kneading water from the water tank 17 were supplied to the solidifying vessel 15, and a package was prepared by operation of the agitator 18. Radioactive concentration of the package obtained in the manner as above described could be calculated from the composition of the package (incinerated ashes/cement/water=5%/62.5%/32.5%) and radioactive concentration of the incinerated ashes(especially important nuclides Ni-59 was $5\times10^{10}$ Bq/t, Sr-90 was $2\times10^{11}$ Bq/t, and a nuclides was $6\times10^{8}$ Bq/t) as $3\times10^{9}$ Bq/t for Ni-59, $1\times10^{10}$ Bq/t for Sr-90, and $3\times10^{7}$ Bq/t for α nuclides at maximum, and it was revealed that the concentration of all of the above described nuclides were less than the upper limit shown in Table 1. Accordingly, packages managing data having the same content as the one shown in FIG. 2 were prepared, and the package was labelled with the ID number and stored in a storage facility.

In accordance with the above described method, not only the radioactive concentration of each package and processing history of the waste can be grasped exactly, but also such problems as difficulty in disposal of the packages on account of high radioactivity when the packages will be intended to dispose in land, for example, in future can be previously resolved.

Embodiment 5

Figure 3:
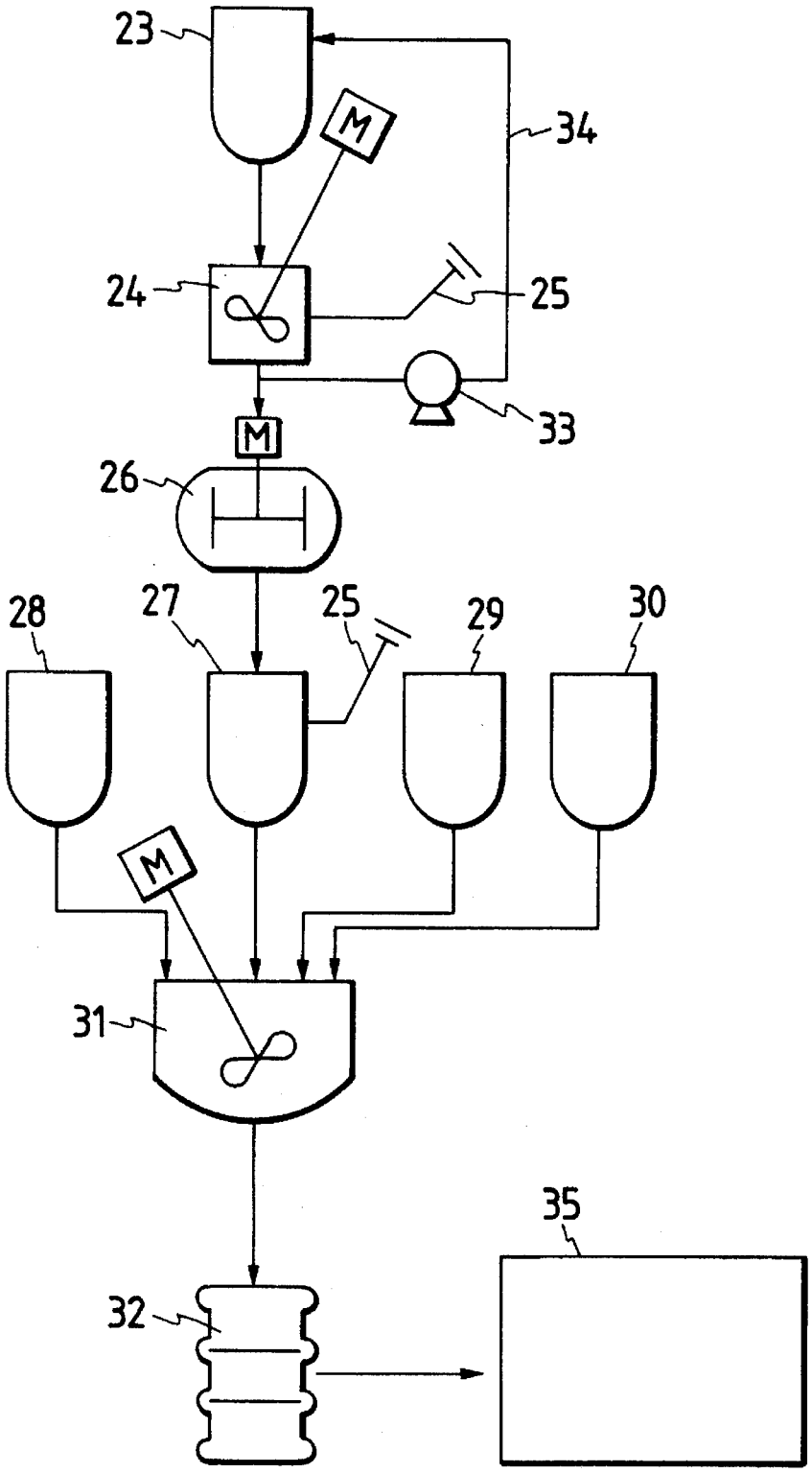
FIG. 3 is a flow diagram for another representative embodiment of the present invention.

Another concrete embodiment of the present invention is explained referring to FIG. 3 hereinafter.

Although the present invention is applicable to general radioactive waste generated from nuclear facilities, radioactive waste resin generated from nuclear power plants is taken as an example in the present embodiment.

At a nuclear power plant, ion exchange resin is used in a reactor clean up system and a condensate clean up system in order to keep properties of reactor water stable. As for waste resin generated from the condensate clean up system, solidifying process has been adopted in practical use. However, waste resin generated from the reactor clean up system, so-called an intermediate level radioactive resin, has been stored in tanks at site of the power station. The present embodiment relates to processing for the stored intermediate level radioactive resin and low level radioactive resin generated from the condensate clean up system, which has an experience to be solidified in practical use.

Radioactive waste resin generated from nuclear power plant is stored in the waste resin storing tank 23 having average storing capacity of 300 $m^3$. The radioactive waste resin (used ion exchange resin) stored in the waste resin storing tank 23 is transferred to the adjusting barrel (adjusting tank) 24 having capacity of from a few cubic meters to tens cubic meters. The adjusting barrel 24 is furnished with the sampling port 25 for measurement of radioactivity. Through the sampling port 25, a small amount of waste resin is taken out from the adjusting barrel 24, and each radioactivity of eleven nuclides such as Co-60, Cs-137, Tc-99, Ni-59, Ni-63, Sr-90, I-129, Nb-94, C-14, H-3, and transuranium elements (TRU), is measured. Depending on the result of the measurement, all amount of waste resin containing Co-60 and Cs-137 of which total radioactivity exceeds a predetermined level, waste resin containing the eleven nuclides of which radioactivity exceeds a predetermined level, and waste resin containing any of the eleven nuclides of which radioactivity exceeds a predetermined level, are returned to the waste resin storing tank 23 from the adjusting barrel 24 by the returning pump 33 through the returning path 34. All amount of the waste resin of which radioactivity does not exceed the predetermined level in the adjusting barrel 24 is transferred to the dehydrator 26, and excess water is removed. Subsequently, the waste resin is introduced to the receiving tank 27. The receiving tank 27 is furnished with the sampling port 25 for radioactivity measurement, and a small amount of the waste resin is taken out from the receiving tank 27 through the sampling port 25. Radioactivities of eleven nuclides such as Co-60, Cs-137, Tc-99, Ni-59, Ni-63, Sr-90, 1-129, Nb-94, C-14, H-3,and TRU in the sample are measured. Depending on the result of the measurement, all amount of waste resin containing Co-60 and Cs-137 of which total radioactivity exceeds a predetermined level, waste resin containing the eleven nuclides of which radioactivity exceeds a predetermined level, and waste resin containing any of the eleven nuclides of which radioactivity exceeds a predetermined level, can be returned to the waste resin storing tank 23 from the receiving tank 27. The measurement of the radioactivity is performed at least at any one of the adjusting barrel 24 and the receiving tank 27. The waste resin of which radioactivity does not exceed the predetermined level is transferred to the kneading barrel 31, and is processed for solidification. For the solidification, cement from the solidifying agent tank 28 and a predetermined amount of kneading water from the water tank 29 are introduced into the kneading barrel 31. Depending on necessity, carbon, metal fiber, absorbing agent, fluidizing agent, and water reducing agent are introduced into the kneading barrel 31 from the additives tank 30, and are sufficiently mixed and kneaded. When filling amount of the resin is increased, the solidification can be preferably performed by preliminary kneading with cement and subsequent main kneading after a few hours or a few days from the preliminary kneading. After the kneading, the mixture is rapidly poured into solidifying vessel 32 (a drum or a PIC vessel). After curing, the completely package is transferred to the package inspection apparatus 35, and weight and surface dose of the package are measured. The obtained data are compared with the data before the solidifying process, and both data are stored. The package through the inspection apparatus 35 becomes an objective for transportation or intermediate storage. When the intermediate storage is elected, the procedure with the package inspection apparatus 35 is not necessarily performed. Filling rate of the radioactive waste resin package prepared in the manner as above described reached to 60 kg/drum at the maximum.

Embodiment 6

Figure 4:
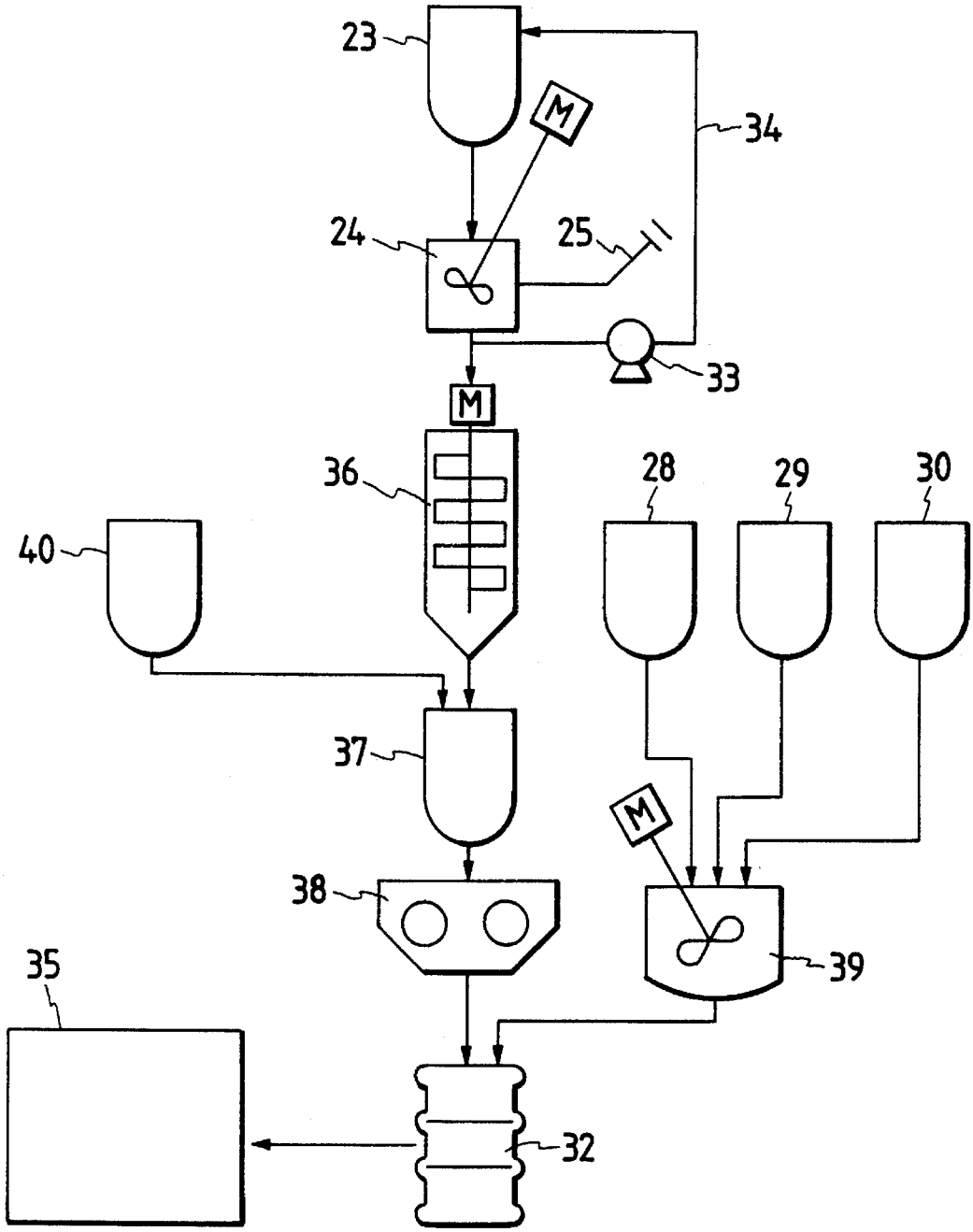
FIG. 4 is a flow diagram for another representative embodiment of the present invention indicating pellet solidifying method.

Next, another embodiment of the present invention is explained referring to FIG. 4.

The present embodiment is also applicable to general radioactive waste generated from nuclear facilities, but radioactive waste resin generated from nuclear power plants is taken as an example in the present embodiment.

At a nuclear power plant, ion exchange resin is used in a reactor clean up system and a condensate clean up system in order to keep properties of the reactor water stable. As for waste resin generated from the condensate clean up system, solidification processing has been adopted in practical use. However, waste resin generated from the reactor clean up system, so-called an intermediate level radioactive resin, has been stored in tanks at site of the power station. The present embodiment relates to processing, especially to pellet solidification, for the storing intermediate level radioactive resin and low level radioactive resin generated from the condensate clean up system, which has experience to be solidified in practical use.

Radioactive waste resin generated from the nuclear power plant is stored in the waste resin storing tank 23 having average storing capacity of 300 $m^3$. The radioactive waste resin (used ion exchange resin) stored in the waste resin storing tank 23 is transferred to the adjusting barrel (adjusting tank) 24 having capacity of from a few cubic meters to tens cubic meters. The adjusting barrel 24 is furnished with the sampling port 25 for measurement of radioactivity. Through the sampling port 25, a small amount of waste resin is taken out from the adjusting barrel 24, and each radioactivity of eleven nuclides such as Co-60, Cs-137, Tc-99, Ni-59, Ni-63, Sr-90, I-129, Nb-94, C-14, H-3, and transuranium elements (TRU), is measured. Depending on the result of the measurement, all amount of waste resin containing Co-60 and Cs-137 of which total radioactivity exceeds a predetermined level, waste resin containing the eleven nuclides of which radioactivity exceeds a predetermined level, and waste resin containing any of the eleven nuclides of which radioactivity exceeds a predetermined level, are returned to the waste resin storing tank 23 from the adjusting barrel 24 by the returning pump 33 through the returning path 34. All amount of the waste resin of which radioactivity does not exceed the predetermined level in the adjusting barrel 24 is introduced into the thin film dryer 36 and pulverized. Subsequently, the waste resin is transferred to the receiving tank 27, and after sufficiently mixed with a small amount of pelletizing binder, the waste resin is introduced to the pelletizer 38 and is pelletized. The pelletized waste resin is rapidly transferred to the solidifying vessel 32 (a drum or a PIC vessel). As for solidifying agent, cement from the solidifying agent tank 28 and a predetermined amount of kneading water from the water tank 29 are introduced into the kneading barrel 39. Depending on necessity, carbon, metal fiber, absorbing agent, fluidizing agent, and water reducing agent are introduced into the kneading barrel 39 from the additives tank 30 , and are sufficiently mixed and kneaded. After the kneading, the mixture is poured into the solidifying vessel 32 (a drum or a PIC vessel) where the pellets are placed. After curing, the completely package is transferred to the package inspection apparatus 35, and weight and surface dose of the package are measured. The obtained data are compared with the data before solidification process, and both data are stored. The package through the inspection apparatus 35 becomes an objective for transportation or intermediate storage. When the intermediate storage is elected, the procedure with the package inspection apparatus 35 is not necessarily performed. Filling rate of the radioactive waste resin package prepared in the manner as above described reached to 120 kg/drum at the maximum.

Embodiment 7

Figure 5:
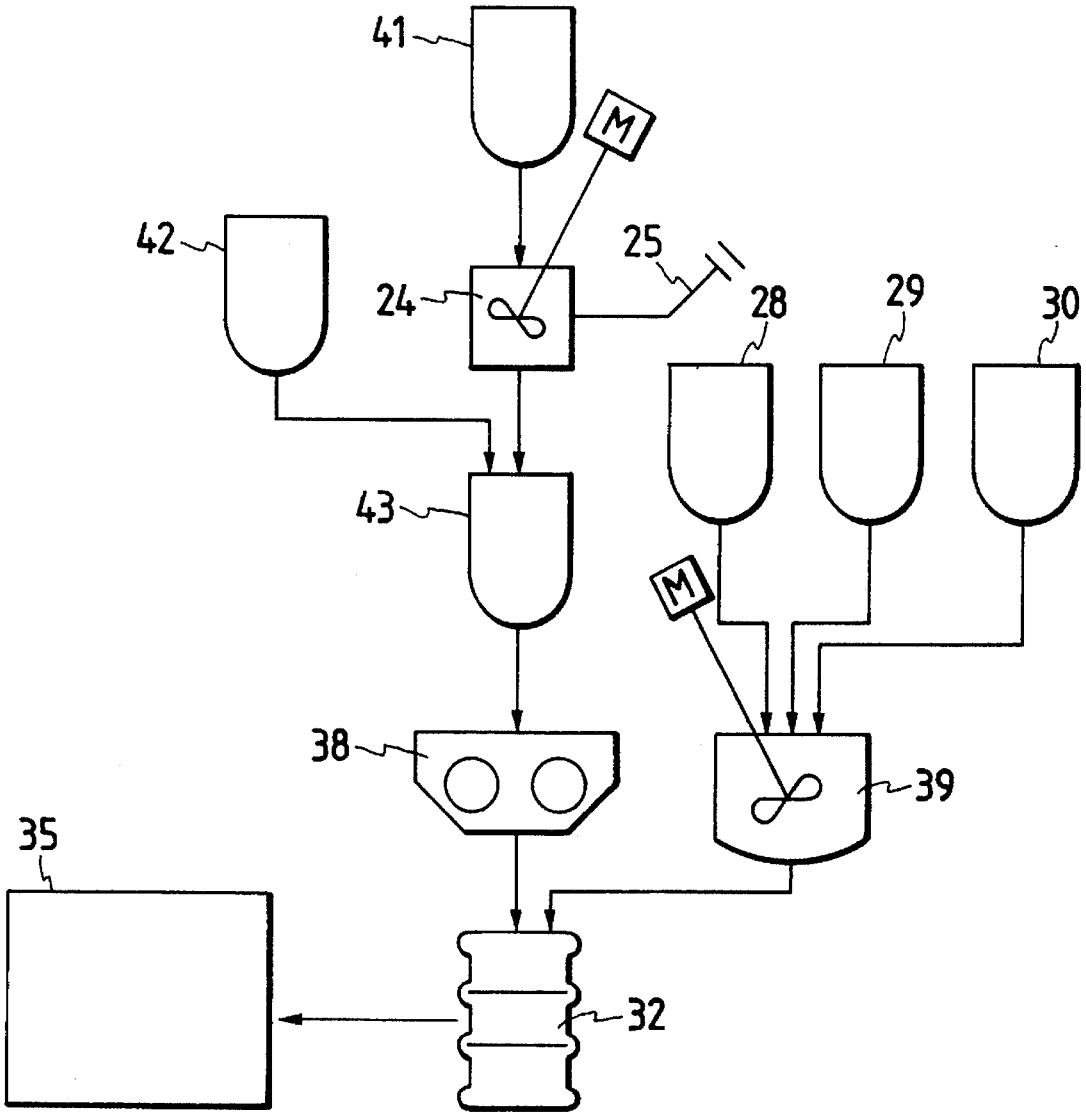
FIG. 5 is a flow diagram for another representative embodiment of the present invention indicating pellet solidifying method.

Farther, another embodiment of the present invention is explained referring to FIG. 5.

The present embodiment is also applicable to general radioactive waste generated from nuclear facilities, but radioactive incinerated ashes generated from nuclear power plants are taken as examples in the present embodiment.

At a nuclear power plant, burnable waste is incinerated for volume reduction in order to decrease amount of generated waste from the nuclear power plant. The present embodiment deals with the above described incinerated ashes as for objectives, especially for pellet solidification of the ashes.

Radioactive incinerated ashes stored in the incinerated ashes storing tank 41 are transferred to the adjusting barrel (adjusting tank) 24 having capacity of from a few cubic meters to tens cubic meters. The adjusting barrel 24 is furnished with the sampling port 25 for measurement of radioactivity. Through the sampling port 25, small amounts of incinerated ashes are taken out from the adjusting barrel 24, and each radioactivity of eleven nuclides such as Co-60, Cs-137, Tc-99, Ni-59, Ni-63, Sr-90, I-129, Nb-94, C-14, H-3, and TRU, is measured. The obtained data are stored. After the measurement, the ashes are transferred to the receiving tank 43. When the observed radioactivity is lower than a predetermined level, the ashes are introduced to solidifying processing system. On the other hand, when the observed radioactivity is higher than the predetermined level, adjustments to decrease filling amount of the ashes in a package or to transmit a predetermined amount of ashes to the receiving tank 43 from the low level incinerated ashes tank 42. The ashes passed the radioactivity measurement or adjusted in the manner as above described are introduced into the pelletizer 38 and pelletized. The pelletized incinerated ashes are rapidly transferred into the solidifying vessel 32 (a drum or a PIC vessel). As for solidifying agent, cement from the solidifying agent tank 28 and a predetermined amount of kneading water from the water tank 29 are introduced into the kneading barrel 39. Depending on necessity, carbon, metal fiber, absorbing agent, fluidizing agent, and water reducing agent etc. are introduced into the kneading barrel 39 from the additives tank 30 , and are sufficiently mixed and kneaded. After the kneading, the mixture is poured into the solidifying vessel 32 (a drum or a PIC vessel) where the pellets are placed. After curing, the completely package is transferred to the package inspection apparatus 35, and weight, surface dose, and radioactivity of the package is measured. The obtained data are compared with the data before solidifying process, and both data are stored. The package through the inspection apparatus 35 becomes an objective for transportation or intermediate storage. When the intermediate storage is elected, the procedure with the package inspection apparatus 35 is not necessarily performed. Filling rate of the radioactive waste resin package prepared in the manner as above described reached to 200 kg/drum at the maximum.

Embodiment 8

Figure 6:
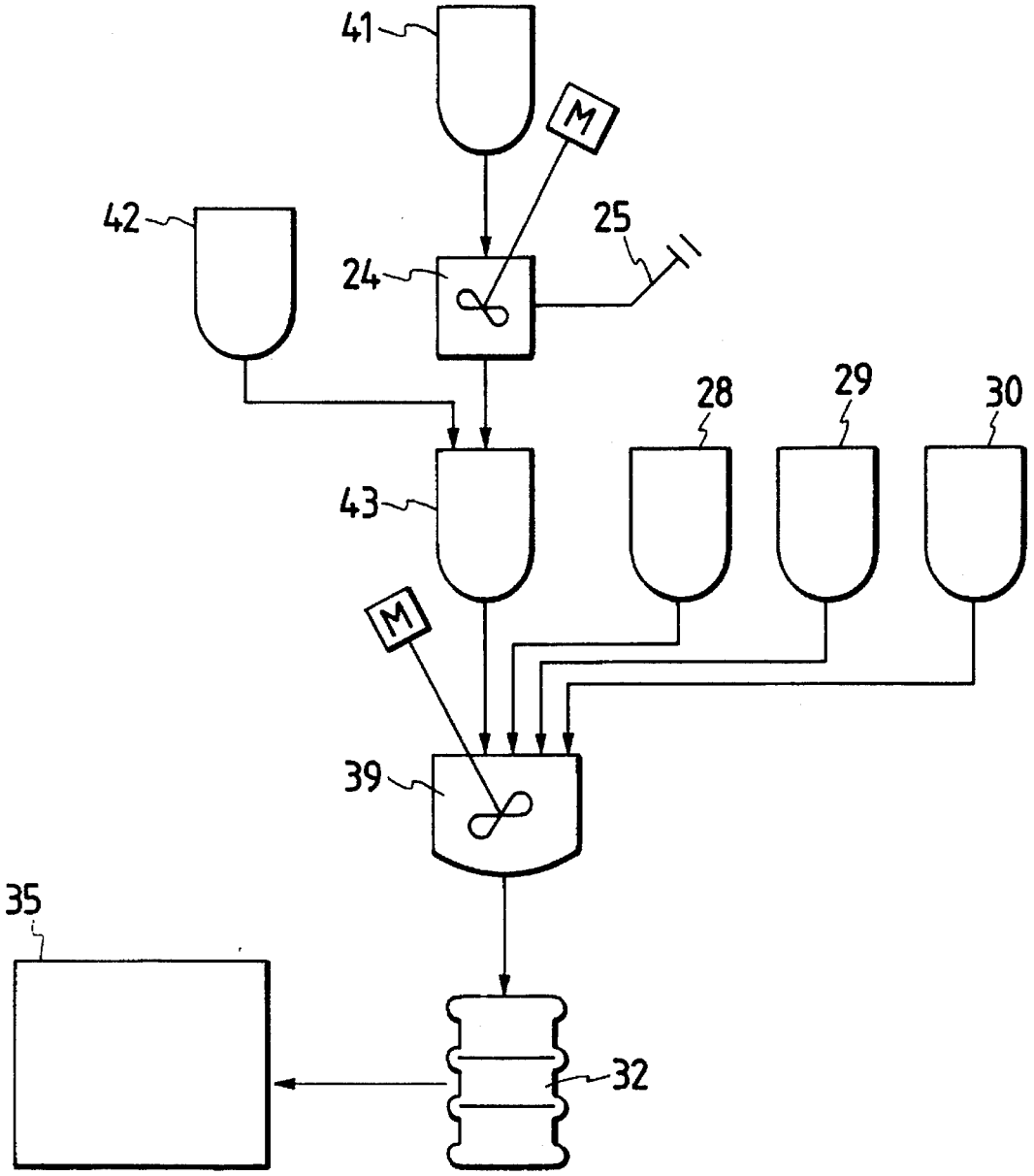
FIG. 6 is a flow diagram for another representative embodiment of the present invention indicating homogeneous solidifying method.

Further, another embodiment of the present invention is explained referring to FIG. 6.

The present embodiment is also applicable to general radioactive waste generated from nuclear facilities, but radioactive incinerated ashes generated from nuclear power plants are taken as examples in the present embodiment.

At a nuclear power plant, burnable waste is incinerated for volume reduction in order to decrease amount of generated waste from the nuclear power plant. The present embodiment deals with the above described incinerated ashes as for objectives, especially for homogeneous solidification method (direct solidification method) of the ashes.

Radioactive incinerated ashes stored in the incinerated ashes storing tank 41 are transferred to the adjusting barrel (adjusting tank) 24 having capacity of from a few cubic meters to tens cubic meters. The adjusting barrel 24 is furnished with the sampling port 25 for measurement of radioactivity. Through the sampling port 25, small amounts of incinerated ashes are taken out from the adjusting barrel 24, and each radioactivity of eleven nuclides such as Co-60, Cs-137, Tc-99, Ni-59, Ni-63, Sr-90, I-129, Nb-94, C-14, H-3, and TRU, is measured. The obtained data are stored. After the measurement, the ashes are transferred to the receiving tank 43. When the observed radioactivity is lower than a predetermined level, the ashes are introduced into solidifying processing system. On the other hand, when the observed radioactivity is higher than the predetermined level, adjustments to decrease filling amount of the ashes in a package or to transmit a predetermined amount of ashes to the receiving tank 43 from the low level incinerated ashes tank 42. After agitating and mixing the ashes homogeneously in the receiving tank 43, the mixture was poured into the kneading barrel 39.

As for solidifying agent, cement from the solidifying agent tank 28 and a predetermined amount of kneading water from the water tank 29 are introduced into the kneading barrel 39. Depending on necessity, carbon, metal fiber, absorbing agent, fluidizing agent, and water reducing agent etc. are introduced into the kneading barrel 39 from the additives tank 30, and are sufficiently mixed and kneaded with the incinerated ashes. After the kneading, the mixture is poured into the solidifying vessel 32 (a drum or a PIC vessel). After curing, the completely package is transferred to the package inspection apparatus 35, and weight, surface dose, and radioactivity of the package are measured. The obtained data are compared with the data before solidification process, and both data are stored. The package through the inspection apparatus 35 becomes an objective for transportation or intermediate storage. When the intermediate storage is elected, the procedure with the package inspection apparatus 35 is not necessarily performed. Filling rate of the radioactive waste resin package prepared in the manner as above described reached to 100 kg/drum at the maximum.

Embodiment 9

Figure 7:
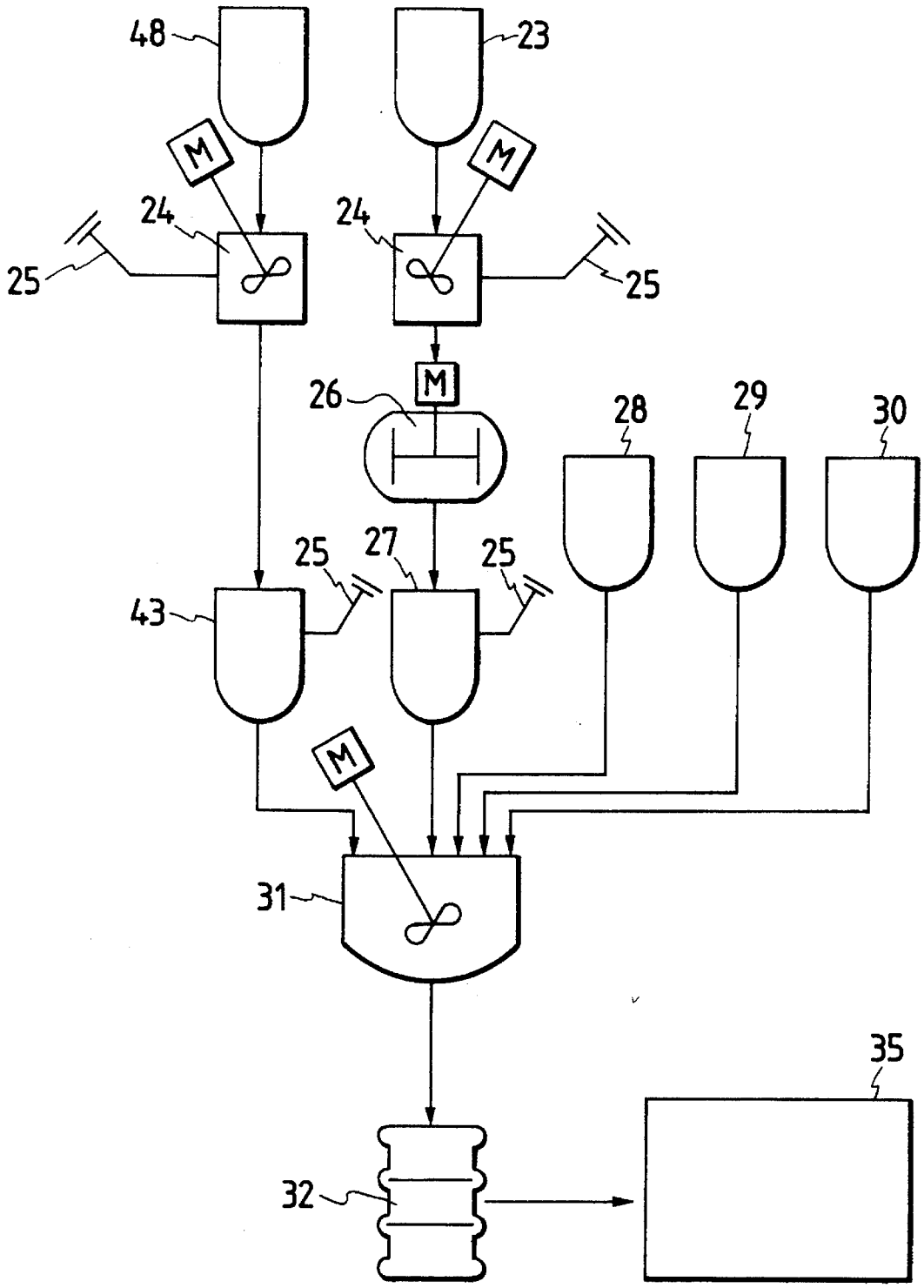
FIG. 7 is a flow diagram for another representative embodiment of the present invention indicating mixed solidifying method.

Next, another embodiment of the present invention is explained referring to FIG. 7.

The present embodiment is also applicable to general radioactive waste generated from nuclear facilities, but radioactive waste resin generated from nuclear power plants is taken as an example in the present embodiment.

At a nuclear power plant, ion exchange resin is used in a reactor clean up system and a condensate clean up system in order to keep properties of the reactor water stable. As for waste resin generated from the condensate clean up system, solidifying process has been adopted in practical use. However, waste resin generated from the reactor clean up system, so-called an intermediate level radioactive resin, has been stored in tanks at site of the power station. The present embodiment explains processing method for the stored intermediate level radioactive resin and low level radioactive resin generated from the condensate clean up system, which has experience to be solidified in practical use, especially for mixed solidification of the intermediate level resin and the low level resin.

Among radioactive waste resin generated from the nuclear power plant, the waste resin having relatively high level radioactivity is stored in the waste resin storing tank 23 having average storing capacity of 300 $m^3$. The radioactive waste resin (used ion exchange resin) stored in the waste resin storing tank 23 is transferred to the adjusting barrel (adjusting tank) 24 having capacity of from a few cubic meters to tens cubic meters. The adjusting barrel 24 is furnished with the sampling port 25 for measurement of radioactivity. Through the sampling port 25, a small amount of waste resin is taken out from the adjusting barrel 24, and each radioactivity of eleven nuclides such as Co-60, Cs-137, Tc-99, Ni-59, Ni-63, Sr-90, I-129, Nb-94, C-14, H-3, and TRU, is measured. Subsequently, total amount of the resin in the adjusting barrel 24 is transferred to the dehydrator 26 and excessive water is removed. After the dehydration, the waste resin is transferred to the receiving tank 27. The receiving tank 27 is furnished with the sampling port 25 for measurement of radioactivity, and through the sampling port 25, a small amount of waste resin is again taken out from the receiving tank 27 as a sample. And each radioactivity of the eleven nuclides such as Co-60, Cs-137, Tc-99, Ni-59, Ni-63, Sr-90, I-129, Nb-94, C-14, H-3, and TRU, is measured. Depending on the result of the measurement, all amount of waste resin containing Co-60 and Cs-137 of which total radioactivity exceeds a predetermined level, waste resin containing the eleven nuclides of which radioactivity exceeds a predetermined level, and waste resin containing any of the eleven nuclides of which radioactivity exceeds a predetermined level, can be returned to the waste resin storing tank 23 from the receiving tank 27. Measurement of the radioactivity is performed at least either of the adjusting barrel 24 or the receiving tank 27.

On the other hand, waste resin having relatively low radioactivity generated from the condensate clean up system is stored in the waste resin storing tank 48, and is transferred to the adjusting barrel (adjusting tank) 24 having capacity of from a few cubic meters to tens cubic meters. The adjusting barrel 24 is furnished with the sampling port 25 for measurement of radioactivity. Through the sampling port 25, a small amount of waste resin is taken out from the adjusting barrel 24, and each radioactivity of eleven nuclides such as Co-60, Cs-137, Tc-99, Ni-59, Ni-63, Sr-90, I-129, Nb-94, C-14, H-3, and TRU, is measured. Subsequently, the waste resin is transferred to the receiving tank 27. The receiving tank 27 is furnished with the sampling port 25 for measurement of radioactivity, and through the sampling port 25, a small amount of waste resin is again taken out from the receiving tank 27 as a sample. And each radioactivity of the eleven nuclides such as Co-60, Cs-137, Tc-99, Ni-59, Ni-63, Sr-90, I-129, Nb-94, C-14, H-3, and TRU, is measured. Depending on the result of the measurement, all amount of waste resin containing Co-60 and Cs-137 of which total radioactivity exceeds a predetermined level, waste resin containing the eleven nuclides of which radioactivity exceeds a predetermined level, and waste resin containing any of the eleven nuclides of which radioactivity exceeds a predetermined level, can be returned to the relatively high level waste resin storing tank 23 from the receiving tank 27. Measurement of the radioactivity is performed at least either of the adjusting barrel 24 or the receiving tank 27. The obtained data are stored. Subsequently, each of the waste resins are introduced into the kneading barrel 31 respectively, and processed for solidification. As solidifying agents, cement from the solidifying agent tank 28 and a predetermined amount of kneading water from the water tank 29 are introduced into the kneading barrel 31. Depending on necessity, carbon, metal fiber, absorbing agent, fluidizing agent, and water reducing agent are introduced into the kneading barrel 31 from the additives tank 30 , and are sufficiently mixed and kneaded. When filling amount of the waste resin is increased, solidification is preferably performed by preliminary kneading with cement and main kneading at a few hours or a few days after the preliminary kneading. After the kneading, the mixture is rapidly introduced into the solidifying vessel 32 (a drum or a PIC vessel). After curing, the completely package is transferred to the package inspection apparatus 35, and weight and surface dose of the package are measured. The obtained data are compared with the data before solidification process, and both data are stored. The package through the inspection apparatus 35 becomes an objective for transportation or intermediate storage. When the intermediate storage is elected, the procedure with the package inspection apparatus 35 is not necessarily performed. Filling rate of the radioactive waste resin package prepared in the manner as above described reached to 60 kg/drum at the maximum. In the present embodiment, low level waste in the waste resin tank 48 can be other than the waste resin, for example, incinerated ashes and condensed waste liquid.

Embodiment 10

Figure 8:
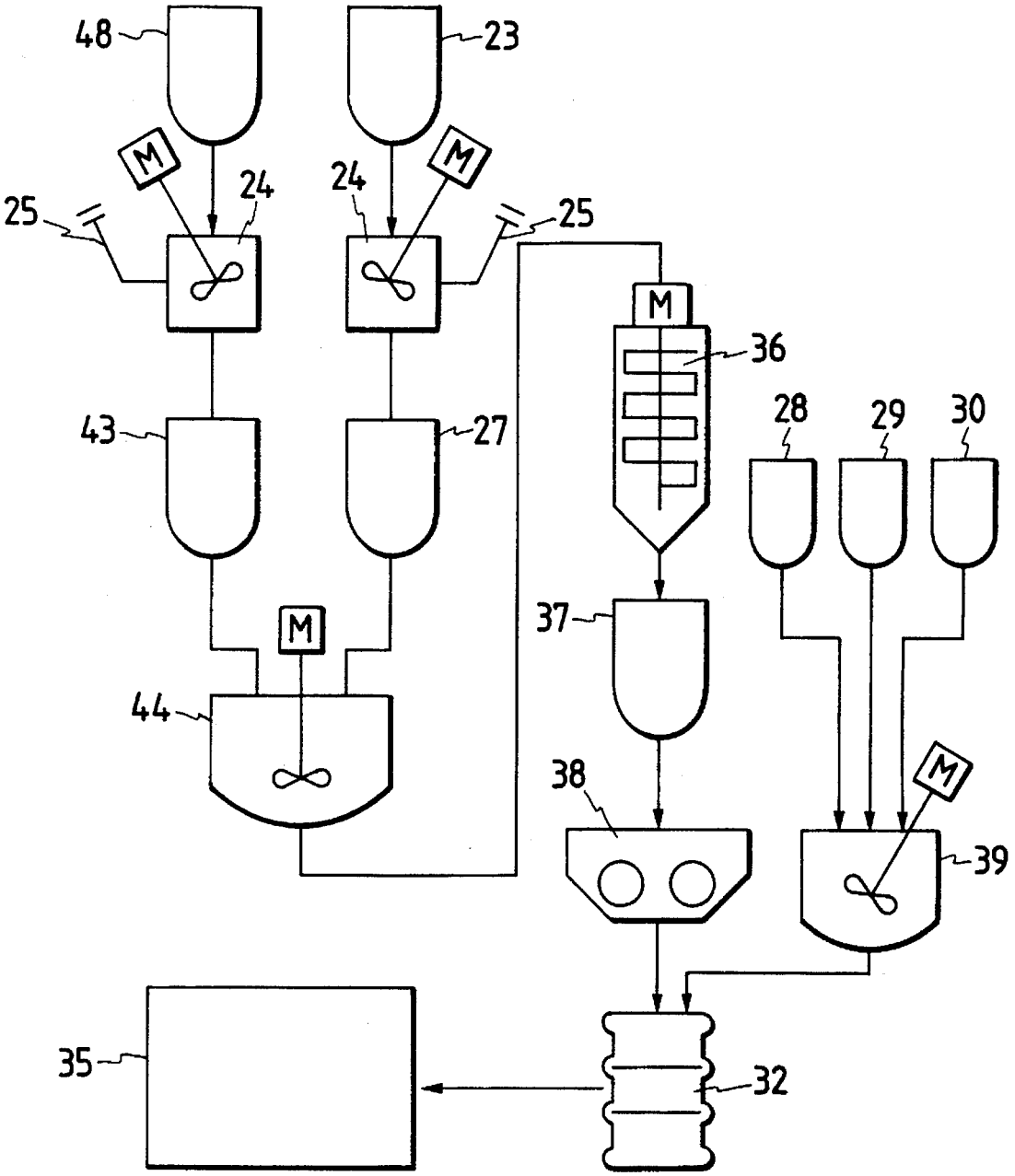
FIG. 8 is a flow diagram for another representative embodiment of the present invention indicating mixed solidifying method.

Next, another embodiment of the present invention is explained referring to FIG. 8.

The present embodiment is also applicable to general radioactive waste generated from nuclear facilities, but radioactive waste resin generated from nuclear power plants is taken as an example in the present embodiment.

Especially, the present embodiment explains mixed solidification of intermediate level radioactive waste resin and low level radioactive waste resin.

Among radioactive waste resin generated from the nuclear power plant, the waste resin having relatively high level radioactivity is stored in the waste resin storing tank 23 having average storing capacity of 300 $m^3$. The radioactive waste resin (used ion exchange resin) stored in the waste resin storing tank 23 is transferred to the adjusting barrel (adjusting tank) 24 having capacity of from a few cubic meters to tens cubic meters. A small amount of waste resin is taken out from the adjusting barrel 24, and each radioactivity of eleven nuclides such as Co-60, Cs-137, Tc-99, Ni-59, Ni-63, Sr-90, I-129, Nb-94, C-14, H-3, and TRU, is measured. Subsequently, total amount of the resin in the adjusting barrel 24 is transferred to the receiving tank 27.

On the other hand, the low level waste resin stored in the waste resin storing tank 48 is transferred to the adjusting barrel (adjusting tank) 24 having capacity of from a few cubic meters to tens cubic meters. A small amount of waste resin is taken out from the adjusting barrel 24, and each radioactivity of eleven nuclides such as Co-60, Cs-137, Tc-99, Ni-59, Ni-63, Sr-90, I-129, Nb-94, C-14, H-3, and TRU, is measured. Subsequently, total amount of the resin in the adjusting barrel 24 is transferred to the receiving tank 43. The obtained measurement data are stored. Subsequently, the both waste resin are introduced into the mixing barrel 44, and mixed to be sufficiently homogeneous. After the mixing, the mixture is introduced into the thin film dryer 36, and dried and pulverized. The dried and pulverized mixture is introduced into the pelletizer 38 through the powder receiving tank 37, and pelletized. The pelletized waste resin is rapidly transferred to the solidifying vessel 32 (a drum or a PIC vessel).

As for solidifying agents, cement from the solidifying agent tank 28 and a predetermined amount of kneading water from the water tank 29 are introduced into the kneading barrel 39. Depending on necessity, carbon, metal fiber, absorbing agent, fluidizing agent, and water reducing agent are introduced into the kneading barrel 39 from the additives tank 30, and are sufficiently mixed and kneaded. After the kneading, the mixture is rapidly poured into the solidifying vessel 32 (a drum or a PIC vessel) in which the pellets are placed. After curing, the completely package is transferred to the package inspection apparatus 35, and weight and surface dose of the package are measured. The obtained data are compared with the data before the solidifying process, and both data are stored. The package through the inspection apparatus 35 becomes an objective for transportation or intermediate storage. When the intermediate storage is elected, the procedure with the package inspection apparatus 35 is not necessarily performed. Filling rate of the radioactive waste resin package prepared in the manner as above described reached to 120 kg/drum at the maximum.

In the present embodiment, low level waste in the waste resin tank 38 can be other than the waste resin such as incinerated ashes and condensed waste liquid.

Embodiment 11

Figure 9:
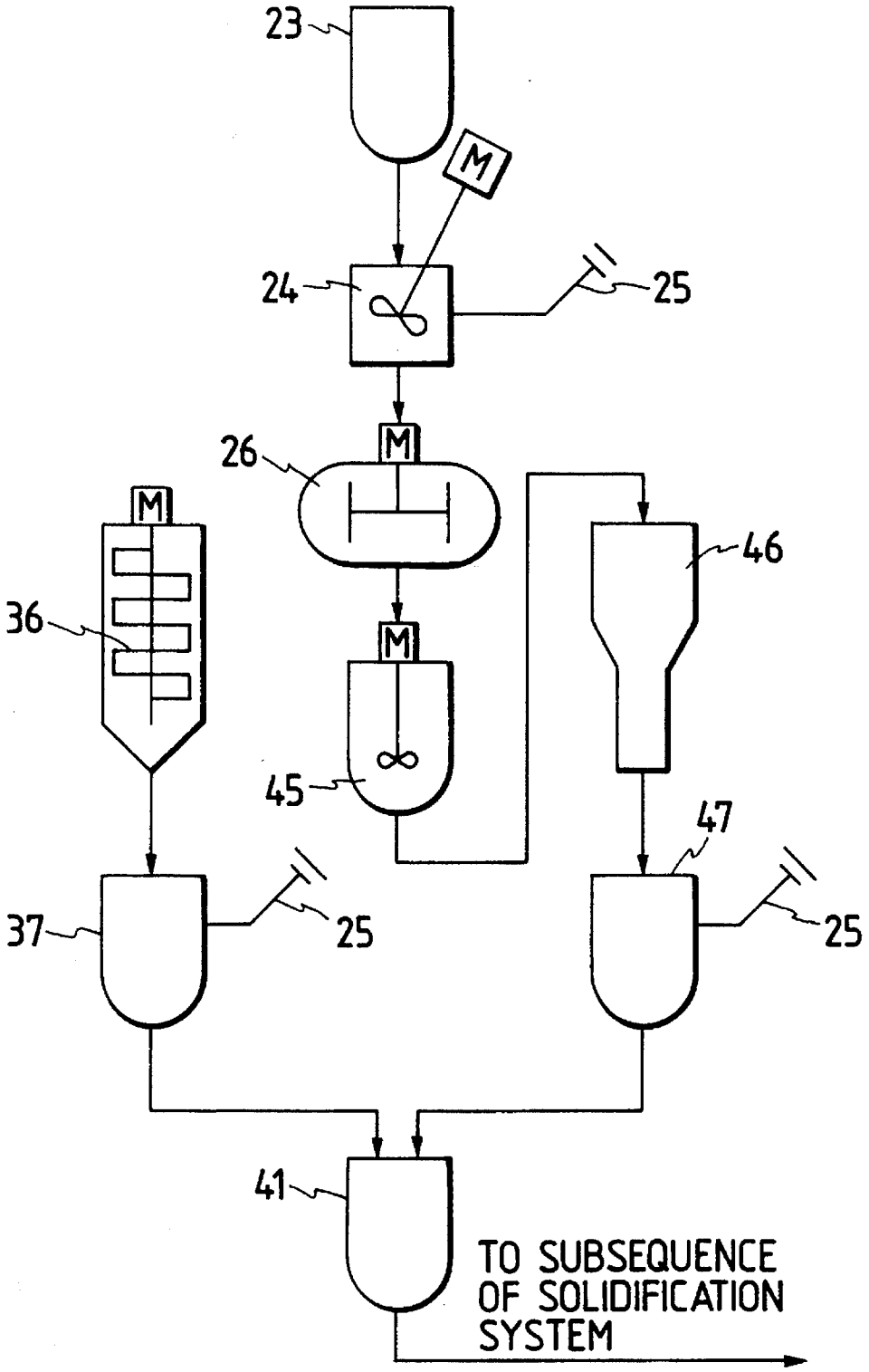
FIG. 9 is a system chart indicating processing method of waste resin.

Next, another embodiment of the present invention is explained referring to FIG. 9.

The present embodiment is also applicable to general radioactive waste generated from nuclear facilities, but radioactive waste resin generated from nuclear power plants is taken as an example in the present embodiment.

Especially, the present embodiment explains preliminary processing system before solidifying processing system.

Among radioactive waste resin generated from the nuclear power plant, the waste resin having relatively high level radioactivity is stored in the waste resin storing tank 23 having average storing capacity of 300 $m^3$. The radioactive waste resin (used ion exchange resin) stored in the waste resin storing tank 23 is transferred to the adjusting barrel (adjusting tank) 24 having capacity of from a few cubic meters to tens cubic meters. The adjusting barrel 24 is furnished with the sampling port 25, and a small amount of waste resin is taken out from the adjusting barrel 24, and each radioactivity of eleven nuclides such as Co-60, Cs-137, Tc-99, Ni-59, Ni-63, Sr-90, I-129, Nb-94, C-14, H-3, and TRU, is measured, and the obtained measurement data are stored. Subsequently, total amount of the resin in the adjusting barrel 24 is introduced into the dehydrator 26, and excessive water is removed. Next, the waste resin is transferred to the dissolution tank 45, and radioactive nuclides and the resin are separated by dissolution. The solution including the radioactive nuclides is dried and pulverized by the thin film drier 36, and transferred to the powder receiving tank 37. The powder receiving tank 37 is furnished with the sampling port 25, and a small amount of the powder is taken out as a sample from the powder receiving tank 37. And each radioactivity of eleven nuclides such as Co-60, Cs-137, Tc-99, Ni-59, Ni-63, Sr-90, I-129, Nb-94, C-14, H-3, and TRU, is measured, and the obtained measurement data are stored as a record.

On the other hand, the processed waste resin by the dissolution is introduced into the incinerator 46, and incinerated. The incinerated ashes are introduced into the incinerated ashes receiving tank 47, which is furnished with the sampling port 25, and a small amount of the incinerated ashes is taken from the incinerated ashes receiving tank 47 as a sample. And each radioactivity of eleven nuclides such as Co-60, Cs-137, Tc-99, Ni-59, Ni-63, Sr-90, I-129, Nb-94, C-14, H-3, and TRU, is measured, and the obtained measurement data are stored as a record.

Both of the powder in the powder receiving tank 37 and the incinerated ashes in the incinerated ashes receiving tank 47 are transmitted into the incinerated ashes storing tank 41 together, and are supplied to the solidifying processing system.

What is claimed is;

1. A processing system for handling radioactive waste after a part or all of a waste slurry, which is comprised of an aqueous slurry of used ion exchange resin generated from nuclear facilities and which is stored in storage tanks, is withdrawn to an adjusting tank and after radioactive concentration of respective nuclides in the waste slurry is measured, which comprises at least one of the following steps:

1) returning the waste slurry to the storage tank without introducing the slurry into a solidifying processing system when the waste slurry is determined to be improper for processing directly, based on the measured radioactive concentration;

2) subjecting the waste slurry to an incineration process when the waste slurry is determined, based on the measured radioactive concentration, to be proper for processing by incineration, and subsequently solidifying residual material remaining from the incineration process by a solidifying process;

3) treating the waste slurry by a thermal decomposition process for removing functional groups and radioactive nuclides when the waste slurry is determined, based on the measured radioactive concentration, to be proper for further processing, and subsequently solidifying residual material obtained from the thermal decomposition process by a solidifying process;

4) subjecting the waste slurry to a dissolution process by removing radioactive nuclides when the waste slurry is determined to be proper for processing to reduce its radioactivity, based on the measured radioactive concentration, and subsequently solidifying the processed waste slurry by a solidifying process;

5) introducing the waste slurry into a solidifying process wherein the waste slurry is solidified with inorganic solidifying materials or organic solidifying materials when the waste slurry is determined to be proper for processing directly, based on the measured radioactive concentration;

6) incinerating the waste slurry when the waste slurry is determined, based on the measured radioactive concentration, to be proper for processing directly, and introducing the gaseous waste generated from the incineration of the waste slurry into a gaseous waste treatment process; or 7) diluting the waste slurry with other waste having low radioactivity when the waste slurry is determined, based on the measured radioactive concentration, to be proper for processing after reducing its level of radioactivity by dilution, so that the radioactivity of a solidified waste body obtained by a subsequent solidifying process exhibits a value within a predetermined limit which is defined as an allowable value for handling of such radioactive waste.

2. A processing system for radioactive waste as claimed in claim 1, wherein said measurement of radioactive concentration of respective nuclides is performed qualitatively and quantitatively by using chemical analysis technique.

3. A processing system for radioactive waste as claimed in claim 1, wherein said measurement of radioactive concentration of respective nuclides is performed, in aspect of the processing applicability evaluation, on at least one of; Co-60, Cs-137, Tc-99, Ni-59, Ni-63, Sr-90, I-129, Nb-94, C-14, H-3, and transuranium elements.

4. A processing system for radioactive waste as claimed in claim 3, wherein said measurement of radioactive concentration of respective nuclides is performed additionally on gamma ray nuclides in aspect of evaluation on compliance with transportation standard after the solidification.

5. A processing system for radioactive waste as claimed in claim 1, wherein said measurement of radioactive concentration of respective nuclides is performed on at least either of Co-60 and Cs-137, and, when an observed value obtained by said measurement exceeds a predetermined value, said waste is returned to the storage tank without performing the measurement of radioactive concentration on another nuclide.

6. A processing system for radioactive waste as claimed in claim 14, wherein said measurement of radioactive concentration of respective nuclides is performed on at least either of Co-60 and Cs-137, and when radioactivities of nuclides other than Co-60 and Cs-137, which are estimated by a scaling factor method for estimating radioactivity of a nuclide based on observed radioactivity of the at least either of Co-60 and Cs-137 with a preferable safety factor, do not exceed predetermined values, transferring said waste to a next processing system with measurement of radioactivity on only either of Co-60 and Cs-137.

7. A processing system for radioactive waste as claimed in claim 14, wherein observed values in said measurement of radioactivity are recorded as data, and said data are stored corresponding to data on radioactivity of each package obtained by the solidifying process.

8. A processing system for radioactive waste as claimed in claim 14, wherein measurement of radioactivity is performed on said waste before a solidifying process and after a solidifying process.

9. A processing system for radioactive waste as claimed in claim 8, wherein measurement of radioactivity on said waste before solidifying process is performed by sampling of said waste directly from the adjusting tank or through a sampling port furnished to the adjusting tank.

10. A processing system for radioactive waste as claimed in claim 8, wherein at least a measuring point for the measurement of radioactivity on said waste is provided in the system.

11. A processing system for radioactive waste as claimed in claim 14, wherein measurement of radioactivity is performed before and after a solidifying process, and the waste includes condensed waste liquid, incinerated ashes, and non-burnable miscellaneous solid bodies.

* * * * *